US009695668B2

(12) United States Patent
Hiorth

(10) Patent No.: US 9,695,668 B2
(45) Date of Patent: Jul. 4, 2017

(54) MILLABLE PLUGGING DEVICE

(71) Applicant: Interwell Technology AS, Ranheim (NO)

(72) Inventor: Espen Hiorth, Trondheim (NO)

(73) Assignee: Interwell Technology AS, Ranheim (NO)

( * ) Notice: Subject to any disclaimer, the term of this patent is extended or adjusted under 35 U.S.C. 154(b) by 213 days.

(21) Appl. No.: 14/767,153

(22) PCT Filed: Nov. 4, 2013

(86) PCT No.: PCT/EP2013/072913
§ 371 (c)(1),
(2) Date: Aug. 11, 2015

(87) PCT Pub. No.: WO2014/124712
PCT Pub. Date: Aug. 21, 2014

(65) Prior Publication Data

US 2015/0376978 A1 Dec. 31, 2015

(30) Foreign Application Priority Data

Feb. 18, 2013 (NO) ..... 20130268

(51) Int. Cl.

| | |
|---|---|
| ***E21B 33/129*** | (2006.01) |
| ***E21B 33/12*** | (2006.01) |
| ***E21B 23/06*** | (2006.01) |
| ***E21B 33/134*** | (2006.01) |

(52) U.S. Cl.
CPC ..... *E21B 33/1291* (2013.01); *E21B 33/1204* (2013.01); *E21B 33/129* (2013.01); *E21B 33/134* (2013.01)

(58) Field of Classification Search
CPC ..... E21B 23/06; E21B 23/01; E21B 33/1204; E21B 33/129; E21B 33/1291; E21B 33/1292; E21B 33/1293
See application file for complete search history.

(56) References Cited

U.S. PATENT DOCUMENTS

2014/0166317 A1* 6/2014 Gregory ..... E21B 33/1204 166/387
2015/0345241 A1* 12/2015 Glaser ..... E21B 23/002 166/382

* cited by examiner

*Primary Examiner* — Cathleen Hutchins
(74) *Attorney, Agent, or Firm* — Osha Liang LLP

(57) ABSTRACT

The present invention relates to a millable plugging device for use in a well pipe. The device includes an inner mandrel and an outer housing provided radially outside at least parts of the inner mandrel. A sealing assembly is provided radially outside the inner mandrel, where the sealing assembly is configured to be brought from a run state to a set state by a relative axial displacement between the inner mandrel and the outer housing. The millable plugging device has a first center axis and the second mandrel section has a second center axis which is displaced parallel in relation to the first center axis. Rotation of the inner mandrel in the set state is bringing a third mandrel section of the mandrel to a locked state, in which further rotation of the inner mandrel is prevented.

10 Claims, 6 Drawing Sheets

MILLABLE PLUGGING DEVICE

FIELD OF THE INVENTION

The present invention relates to a millable plugging device. In particular, the present invention relates to a millable permanent plugging device.

BACKGROUND OF THE INVENTION

Plugging devices are common tools used in oil and/or gas wells. Plugging devices normally comprises an inner mandrel and an outer housing, where axial displacement of the inner mandrel with respect to the outer housing provides a setting operation of the plugging device. During the setting operation, a sealing device is radially expanded from a run state to a set state. The sealing device comprises a sealing element which is preventing axial fluid flow between the outer housing and the inner surface of the well pipe and slips devices which is anchoring the plugging device to the inner surface of the well pipe. Some plugging devices are denoted as packers, i.e. the inner mandrel comprises a bore with a valve, where fluid flow is allowed through the bore when the valve is open and where fluid flow is prevented through the bore when the valve is closed.

Retrievable plugging devices are designed for retrieval from the well after its use by means of a retrieval tool, while permanent plugging devices are set in the well permanently. Permanent plugging devices are normally simpler in their design, and may withstand higher temperatures and/or pressure than retrievable plugging devices. The only way to remove a permanent plugging device is to destroy it by milling or by use of explosives etc.

If a retrievable plugging device is set in a well for several years, it is a common problem that the release mechanism does not work anymore, and hence also the retrievable plugging device must be destroyed by milling in order to remove it.

Hence, millable or drillable permanent plugging devices have been developed. They have the advantages of the permanent plugging device (i.e. simple design, may withstand high pressure and/or high temperature), but are made of materials that are easier to remove by milling, i.e. they may be made of composite materials, cast iron, brass etc.

One problem which may occur during milling is that the inner mandrel is rotating together with the mill relative to the outer housing. During this rotation, there is no milling progress of the inner mandrel, and the milling tool is prevented from milling other parts of the plugging device as well. In such cases, it may be necessary to put a lot of weight on the milling bit and/or to increase the rotation rate of the milling bit, in order to "weld" the inner mandrel to the outer housing by the resulting increased temperature, and thereby prevent relative rotation. If this does not work, it may be necessary to pump cement on top of the plugging device and let that harden before trying the milling operation again.

Another problem which may occur is that during milling, the different parts of the plugging device disassembles and falls into the well. If those disassembled parts are too big, a fishing operation may be performed in order to remove them from the well. The fishing operation is simpler when for example using magnets if the disassembled parts are relatively small. Moreover, the fishing operation may not even be necessary if the disassembled parts so small that they can be pumped away from the well bore.

One solution to this problem is to provide the inner mandrel with a non-circular outer surface and the outer housing with a corresponding non-circular inner surface in order to prevent relative rotation between the inner mandrel and the outer housing. Such a solution is shown in U.S. Pat. No. 6,491,108. One disadvantage here is that it is very expensive to machine the non-circular shapes of the inner and outer housings. Moreover, it is difficult to provide reliable seals, such as o-rings, supporting sealing rings etc. for such non-circular mandrels. Hence, it is difficult to achieve certain product ratings, for example the ISO 14310: 2008 V0 rating, for such plugging devices.

US 2010/0132960 describes a drillable bridge plug with a mandrel having external splines disposed on an outer surface of the mandrel, a sealing element disposed around the mandrel, an upper cone disposed around the mandrel proximate an upper end of the sealing element, and a lower cone disposed around the mandrel proximate the lower end of the sealing element. An inner surface of the lower cone comprises internal splines configured to engage the external splines.

US 2012/0255723 describes a slip for use in the anchoring of a downhole tool in a well casing is provided. The slip's outer diameter is about equal to the inner diameter of the well casing. The slip is positioned about a mandrel and radially expands upon the application of force. The wickers on the slip deformably engage the casing in response to a force US 2007/0246224 describes a float equipment being constructed to have the check valve in an offset and/or skewed position with respect to the centerline of the tubular housing that is part of a string. The design is applicable to poppet type check valves as well as flapper type valves that are actuated with a flow tube. The off center and/or skewed position of the valve components allows the cutting structure on a drill bit, rather than the nozzle area on the bit bottom to make intimate contact with the valve components to accelerate the milling one of the assembly and the making of additional hole beyond the recently cemented string.

The object of the invention is to provide a plugging device which can be milled out from a well in a reliable and efficient way. Hence, the object of the invention is to provide a millable plugging device where the disadvantages with prior art plugging devices are avoided. Another object is to provide that as much as possible of the plugging device is milled before the plugging device disassemble and fall into the well.

SUMMARY OF THE INVENTION

The invention relates to a millable plugging device for use in a well pipe, comprising:

- a inner mandrel comprising a first mandrel section and a second mandrel section, where the first mandrel section has a cylindrical outer surface and where the second mandrel section has a cylindrical outer surface;
- an outer housing provided radially outside at least parts of the inner mandrel, where the outer housing comprises a first housing section and a second housing section, where the second housing section comprises a cylindrical compartment;
- a sealing assembly provided radially outside the inner mandrel, where the sealing assembly is configured to be brought from a run state to a set state by a relative axial displacement between the inner mandrel and the outer housing;

where the millable plugging device has a first center axis;

characterized in that the second mandrel section has a second center axis is displaced parallel in relation to the first center axis;

at least parts of the second mandrel section is provided within the compartment in the set state;

where rotation of the inner mandrel in the set state is bringing a third mandrel section of the mandrel to a locked state, in which further rotation of the inner mandrel is prevented.

When the rotation of the inner mandrel is prevented, the inner mandrel will not rotate together with the mill or mill bit. Hence, the inner mandrel will be milled into debris.

In one aspect, the third mandrel section comprises a first contact area which is brought into contact with the well pipe in the locked state.

In one aspect, the first contact area comprises radially protruding slips.

In one aspect, rotation of the outer housing in the set state is bringing a third housing section of the outer housing to a locked state, in which further rotation of the outer housing is prevented. Hence, it is ensured that the outer housing will not rotate together with the mill or mill bit.

In one aspect, the third housing section comprises a second contact area which is brought into contact with the well pipe in the locked state.

In one aspect, the second contact area comprises radially protruding slips.

In one aspect, the third mandrel section is provided below the sealing assembly.

In one aspect, the first mandrel section is guided through an opening provided in the first housing section.

In one aspect, the first mandrel section comprises a first fastening mechanism and the first housing section comprises a second fastening mechanism, where the first fastening mechanism can be fastened to the second fastening mechanism during setting of the plugging device.

In one aspect, the first and second fastening mechanisms are provided by a ratchet mechanism.

DETAILED DESCRIPTION

Embodiments of the invention will now be described with reference to the enclosed drawings, where:

Figure 10C:
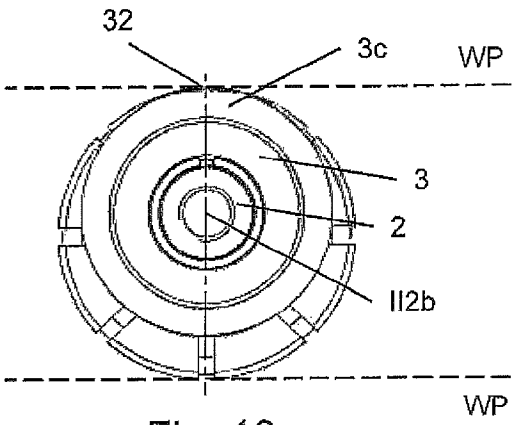
Figure 10B:
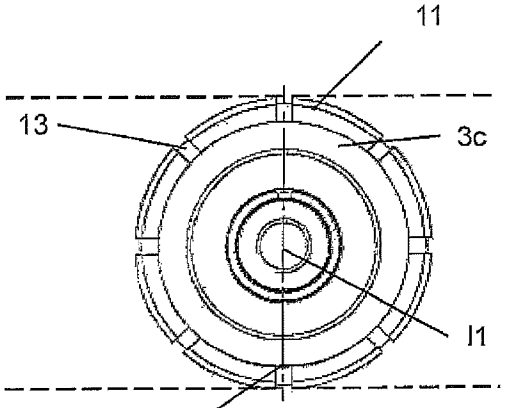
Figure 10A:
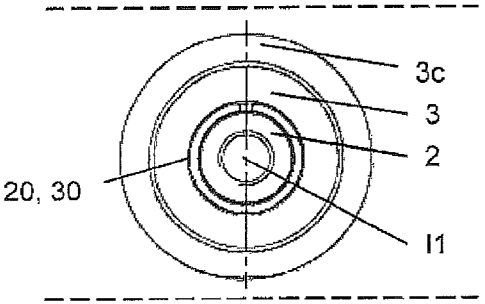

FIG. 10*a*, 10*b*, 10*c* illustrates the plugging device seen from above in the run, set, and locked states respectively.

First, it should be noted that the term "milling" ("mill", "millable" etc) is used herein for all operations involving a rotary tool for removing a plugging device in a well by cutting the plugging device into smaller pieces. Hence, the term "millable" and "drillable" are used synonymously in the description below.

Figure 1:
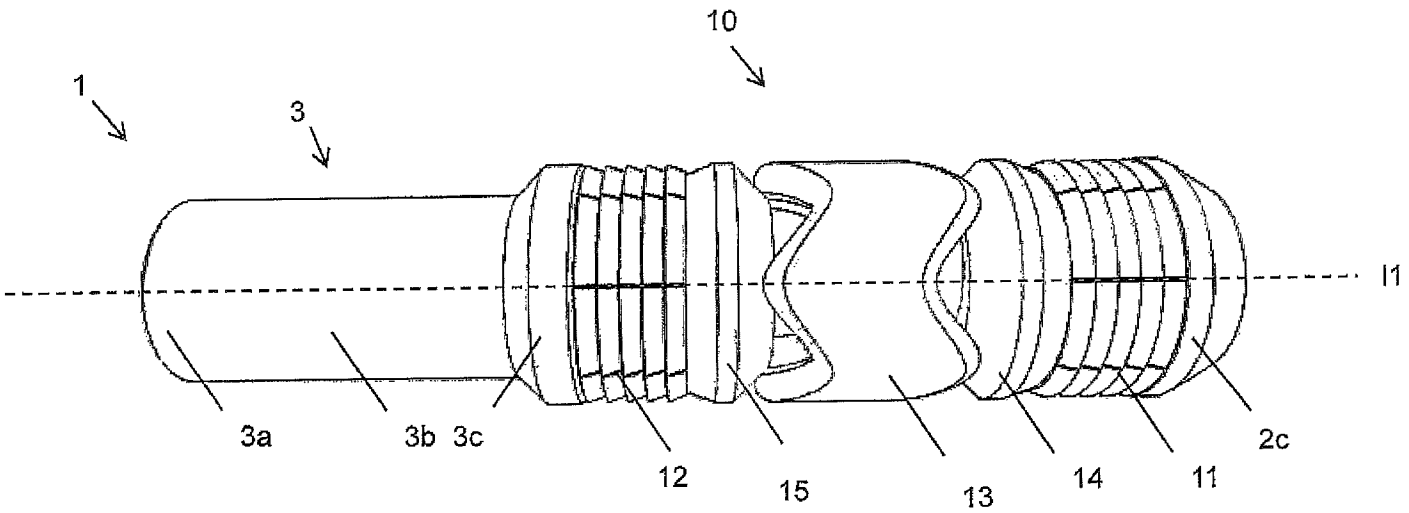
FIG. 1 illustrates a side view of a first embodiment in a run state.
Figure 2:
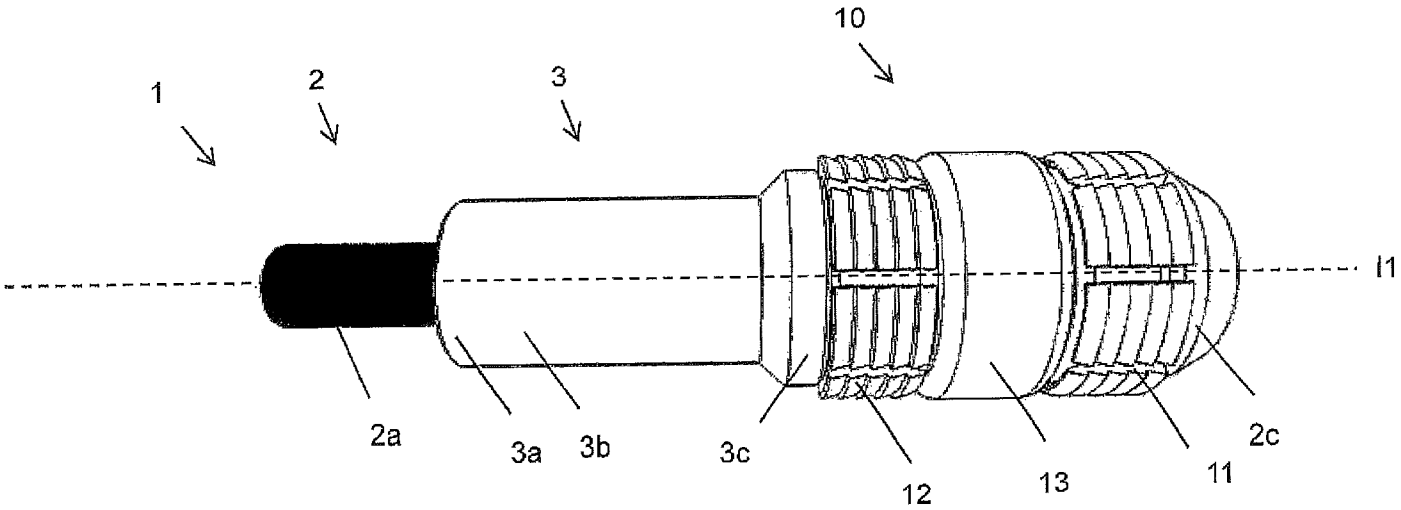
FIG. 2 illustrates a side view of a first embodiment in a set state.

It is now referred to FIGS. 1 and 2. Here, a plugging device 1 is shown. The plugging device is here a plug for use in a well pipe, such as an oil and/or gas well, oil and/or gas pipe etc. In the drawings, the left side of the plugging device is the "upper" side of the plugging device 1, i.e. the side that is closest to the surface of the well. The right side of the plugging device is the "lower" side of the plugging device 1, i.e. the side that is farthest away from the surface of the well.

The plugging device comprises an inner mandrel 2 and an outer housing 3 provided radially outside at least parts of the inner mandrel 2. In FIG. 1, only the lower section 2*c* of the mandrel 2 is visible.

The plugging device further comprises a sealing assembly 10 provided radially outside the inner mandrel 2. The sealing assembly 10 is configured to be brought from a run state to a set state by a relative axial displacement between the inner mandrel 2 and the outer housing 3. The sealing assembly 10 here comprises first and second slips devices 11, 12 and a sealing element 13 provided axially between the first and second slips devices 11, 12. The sealing assembly 10 here also comprises first and second cone devices 14, 15 provided between each of the slips devices 11, 12 and the sealing element 13. The first and second cone devices 14, 15 are guiding the slips devices 11, 12 from their run state to their set state and are also compressing the sealing element 13 axially in the set state.

Figure 7:
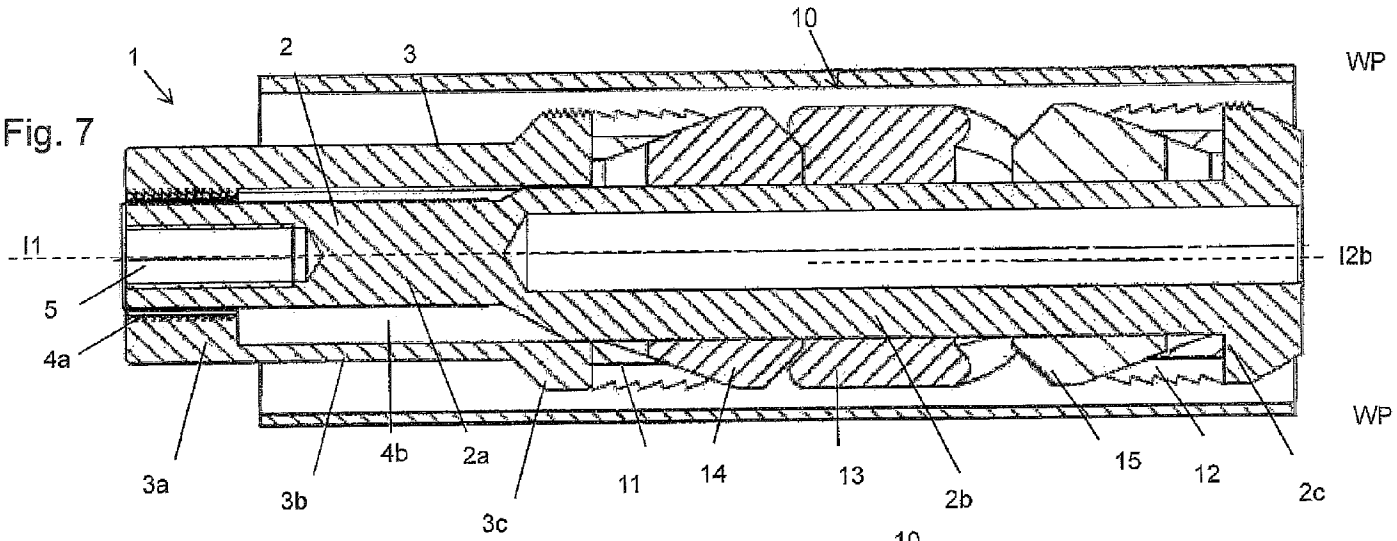
FIG. 7 illustrates a cross sectional side view of a second embodiment of the plugging device in the run state.
Figure 8:
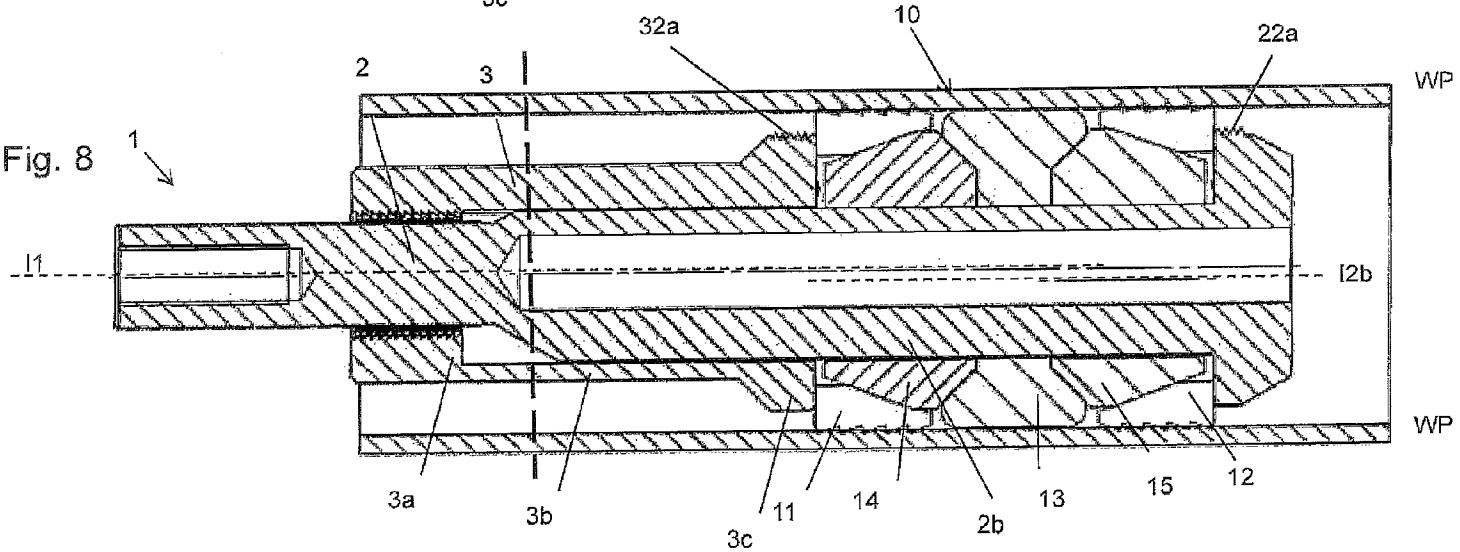
FIG. 8 illustrates a cross sectional side view of the second embodiment of the plugging device in the set state.

In FIG. 1, the run state is shown. In this state, the plugging device is brought to the desired location in the well. At the desired location, the setting tool brings the plugging device from the run state to the set state by a relative axial displacement between the inner mandrel 2 and the outer housing 3. In FIG. 2 it is shown that an upper section 2*a* of the mandrel 2 has been pulled upwardly (i.e. to the left) in relation to the outer housing 3, thereby causing an axial compression and hence a radial expansion of the slips devices 11, 12 and the sealing element 13. This is also shown in FIGS. 7 and 8. In FIG. 7 the plugging device is in the run state at the desired location in the well, in FIG. 8 the plugging device is in the set state where the slips devices 11, 12 and the sealing element 13 are in contact with the inner surface of the well pipe denoted as WP. The plugging device 1 now forms a plug in the well pipe WP, where fluid is prevented from passing it.

In FIG. 7, it is shown that the first mandrel section 2*a* comprises a connection interface 5 for connection to the setting tool.

It should be noted that the sealing assembly 10 is considered known for a person skilled in the art, and will not be described further in detail herein.

In FIGS. 1 and 2, it is shown that the millable plugging device 1 has a substantial cylindrical outer shape. A center axis I1, hereinafter referred to as the first center axis I1, is indicated by a dashed line. In the set state, the first center axis I1 will coincide with the center axis of the well pipe (assuming that the well pipe also is cylindrical).

Figure 3:
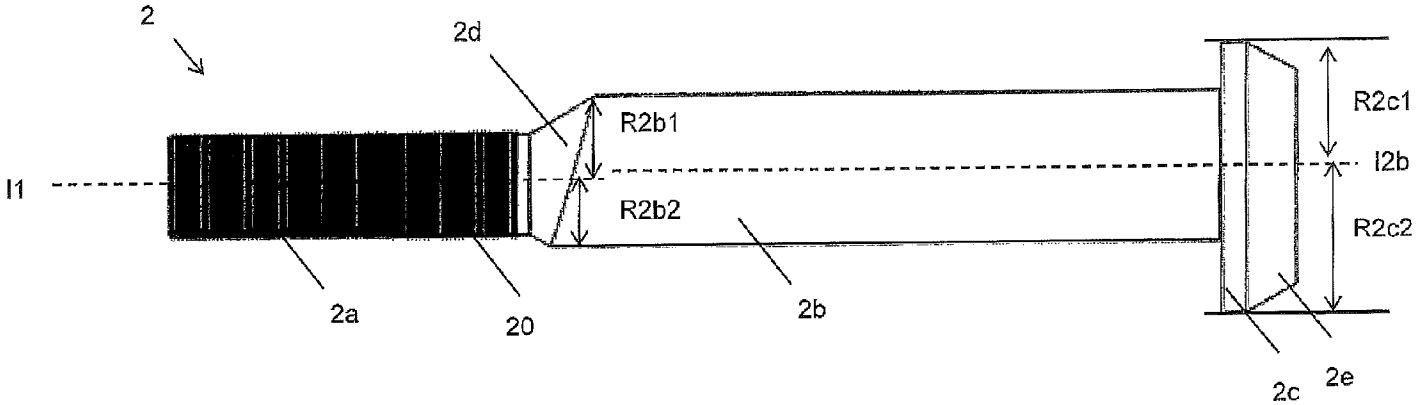
FIG. 3 illustrates a side view of the mandrel of the plugging device.

It is now referred to FIG. 3, where it is shown that the mandrel 2 is comprising a first or upper mandrel section 2*a*, a second mandrel section 2*b* and a third or lower mandrel section 2*c*. The first mandrel section 2*a* has a cylindrical outer surface and the second mandrel section 2*b* has a cylindrical outer surface. Also the third mandrel section 2*c* has a cylindrical outer surface. In FIG. 3 it is also shown that the mandrel 2 comprises a fourth mandrel section 2*d* between the first mandrel section 2*a* and the second mandrel section 2*b*, which will be described below. In FIG. 3 it is also shown that the third mandrel section 2*c* may comprises a tapering nose area 2*e* in order to ease the running of the plugging device 1 into the well pipe.

In FIG. 3, it is shown that the second mandrel section 2*b* has a second center axis I2*b* which is displaced parallel in relation to the first center axis I1. Consequently, the second mandrel section 2*b* is provided eccentric in relation to other parts of the plugging device and also in relation to the well pipe. The first mandrel section 2*a* has a center axis coinciding with the first center axis I1. Hence, the fourth mandrel section 2*d* provides a tapering area between the first mandrel section 2*a* and the second mandrel section 2*b*.

Figure 5:
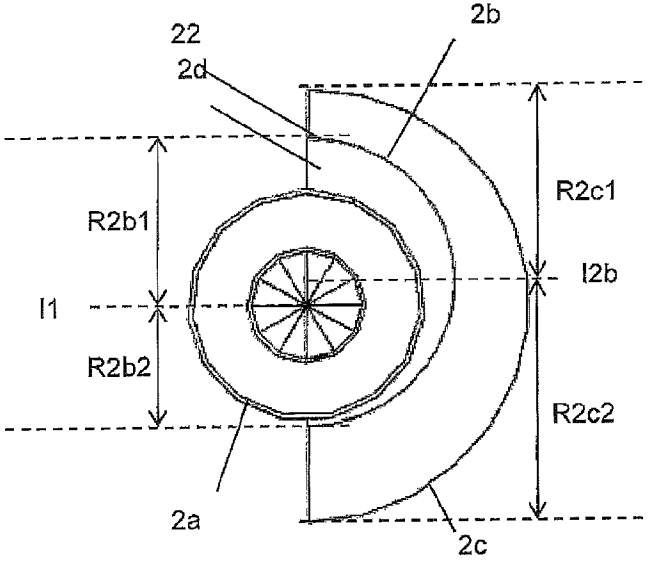
FIG. 5 illustrates a top view of the mandrel.

In FIG. 3 and FIG. 5, it is shown that a first mandrel radius R2*b*1 representing the longest radial distance between the outer surface of the second mandrel section 2*b* to the first center axis 12 is longer than a second mandrel radius R2*b*2 representing the shortest radial distance between the outer surface of the second mandrel section 2*b* to the first center axis 12). Moreover, it is shown that a third mandrel radius R2*c*1 representing the shortest radial distance between the outer surface of the third mandrel section 2*c* to the second center axis I2*b* is shorter than a fourth mandrel radius R2*c*2 representing the longest radial distance between the outer surface of the third mandrel section 2*c* to the second center axis I2*b*. As shown, the first mandrel radius R2*b*1 is provided radially in the same direction (up in FIG. 5) as the third mandrel radius R2*c*1. The second mandrel radius R2*b*2 is provided radially in the same direction (down in FIG. 5) as the fourth mandrel radius R2*c*2. As shown, the first and third mandrel radiuses are oriented 180° in relation to the second and fourth mandrel radiuses.

As shown in FIG. 3, the diameter of the third mandrel section 2*c* is larger than the diameter of the second mandrel section 2*b*. Hence, the third mandrel section 2*c* forms a stopping surface used to compress the sealing assembly 10 against during setting of the plugging device.

Figure 4:
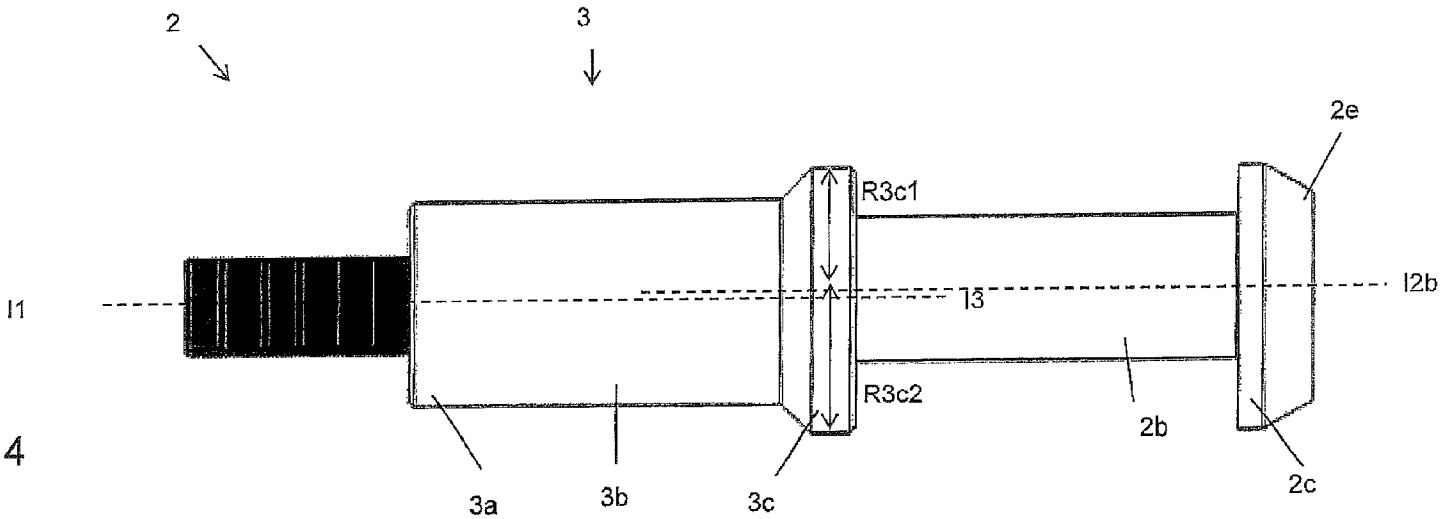
FIG. 4 illustrates a side view of the mandrel and the outer housing in the set state.
Figure 6:
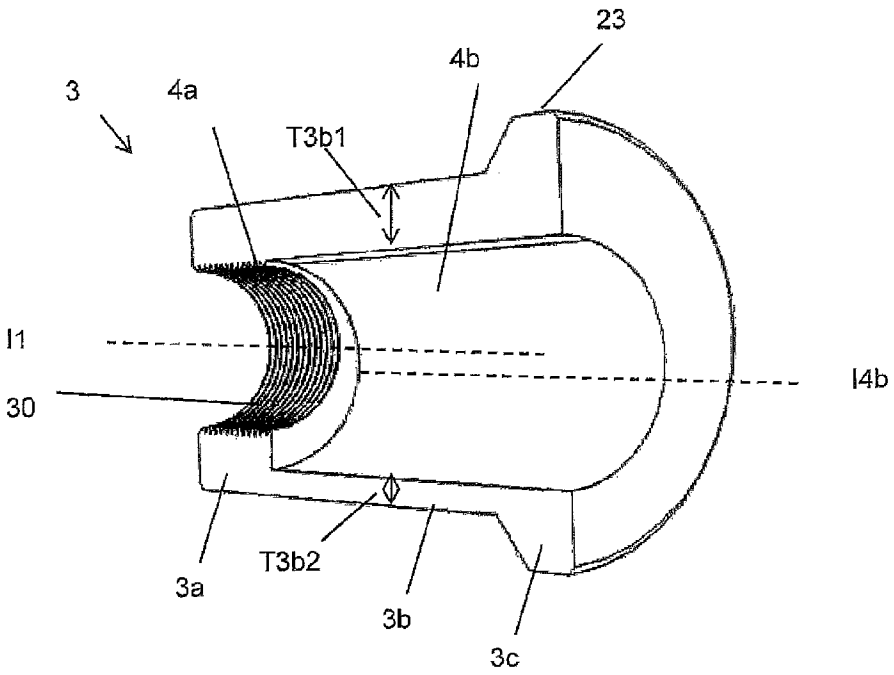
FIG. 6 illustrates a perspective, cross sectional view of the outer housing.

It is now referred to FIG. 4 and FIG. 6. The outer housing 3 is provided radially outside at least parts of the inner mandrel 2. The outer housing 3 comprises a first housing section 3*a*, a second housing section 3*b* and a third housing section 3*c*. In the present embodiment, the outer housing 3 forms a part of the outer surface of the plugging device 1. Hence, the outer surface of the outer housing 3 is substantially cylindrical.

The first housing section 3*a* comprises an opening 4*a*. The first mandrel section 2*a* is guided through the opening 4*a* provided in the first housing section 3*a*. The first mandrel section 2*a* comprises a first fastening mechanism 20 and the first housing section 3*a* comprises a second fastening mechanism 30. The first fastening mechanism 20 can be fastened to the second fastening mechanism 30 during setting of the plugging device 1. Hence, the fastening mechanisms 20, 30 are providing an axial fixation of the mandrel 2 in relation to the housing 3. The fastening mechanisms 20, 30 allows axial movement which is bringing the third mandrel section 2*c* closer to the third housing section 3*c*, but prevents movement in the opposite direction, i.e. bringing the plugging device from the run state to the set state is allowed, but bringing the plugging device from the set state to the run state is not allowed. The first and second fastening mechanisms 20, 30 may be provided by a ratchet mechanism.

The second housing section 3*b* comprises a cylindrical compartment 4*b*. At least parts of the second mandrel section 2*b* is provided within the compartment 4*b* in the set state. In the run state in FIG. 7, only a small part of the second mandrel section 2*b* is provided within the compartment 4*b*, while in the set state in FIG. 8, the second mandrel section 2*b* is almost filling the entire compartment 4*b*. In the present embodiment, the cylindrical compartment 4*b* is also provided in the third housing section 3*c*, as shown in FIG. 6. Hence, the opening 4*a* and the compartment 4*c* form an axial opening through the housing 3, in which the mandrel 2 is provided.

In FIG. 6, it is shown that the opening 4*a* is provided centrally in the housing 3, i.e. it is also centrally provided in the plugging device 1. However, the compartment 4*b* has a third center axis I4*b*, which is corresponding to the second center axis of the second mandrel section 2*b* in the run and set states. That is, the third center axis I4*b* is also displaced parallel in relation to the first center axis I1. Obviously, the second and third center axis I2*b*, I4*b* is coinciding.

It should be noted that in the set state (and in the present embodiment also in the run state), relative rotational movement between the inner mandrel 2 and the outer housing 3 is not possible due to the eccentricity of the second mandrel section 2*b* within the compartment 4*b*, as long as the first mandrel section 2*a* is provided through the centrally oriented opening 4*a*.

In the following, the milling operation of the plugging device will be explained in detail. It is assumed that the plugging device 1 has been set as shown and explained above with reference to FIG. 8. Here, the slips devices 11, 12 is preventing axial movement of the plugging device in relation to the pipe wall WP, and the sealing element 13 is preventing fluid from passing between the inner surface of the well pipe and the outer surface of the sealing element 13 and between the inner surface of the sealing element 13 and the outer surface of the second mandrel section 2*b*.

The milling operation is now starting, and a rotating milling tool is lowered into the well. The milling tool is considered known for a person skilled in the art and will not be described herein in detail. The milling bit of the milling tool is assumed to rotate clockwise with a rotation axis coinciding with the first center axis I1 of the plugging device. However, it is of course also possible to use other milling tools.

The milling tool will first start milling of the first mandrel section 2*a*. Due to the eccentricity of the second mandrel section 2*b*, it is not possible for the mandrel 2 to rotate within the housing 3. Hence, if friction forces provided by the sealing element 13 is not sufficient to hold the mandrel 2 with respect to the pipe wall WP, the mandrel 2 and the outer housing 3 will start to rotate together with the milling bit in relation to the sealing assembly 10.

However, due to the eccentricity, the rotation of the inner mandrel 2 in the set state will bring the third mandrel section 2*c* of the mandrel 2 to a locked state, in which further rotation of the inner mandrel 2 is prevented. As shown in FIG. 8 the distance from the upper outer surface of the third mandrel section 2*c* to the inner surface of the well pipe WP is equal to the distance from the lower outer surface of the third mandrel section 2*c* to the inner surface of the well pipe.

Figure 9:
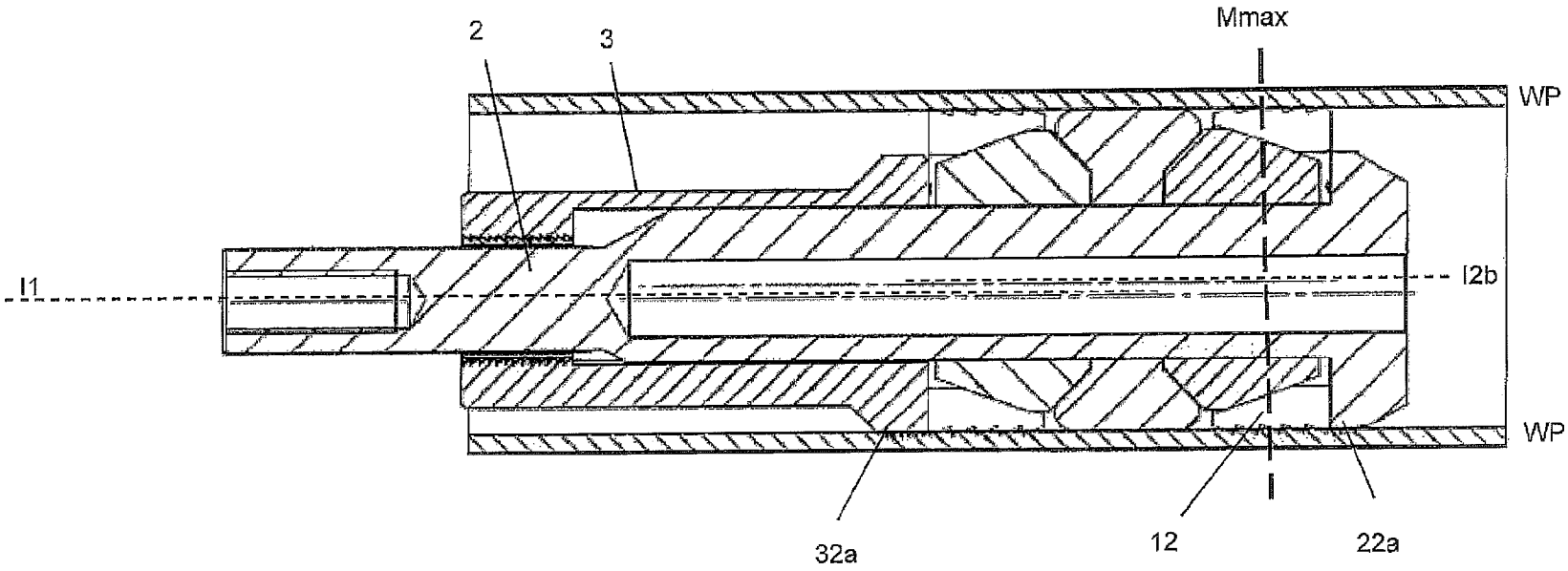
FIG. 9 illustrates a cross sectional side view of the second embodiment of the plugging device in the locked state.

In the locked state shown in FIG. 9 the mandrel 2 has rotated about the second center axis I2*b* and a first contact area denoted with reference number 22 in FIG. 8 has been brought into contact with the well pipe WP as shown in FIG. 9. Here, further rotation of the mandrel 2 in relation to the sealing assembly 10 is no longer possible, and the milling bit will again be able to mill the mandrel 2. As shown in FIGS. 8 and 9, the contact area 22 is comprising radially protruding slips 22*a* for contact with the well pipe WP in the locked state. However, this is only a preferred embodiment, in the first embodiment of FIGS. 1 and 2, there are no such slips 22*a*.

It should be noted that in the locked state of the mandrel 2, also rotation of the housing 3 is prevented due to the eccentricity of the second mandrel section 2*b* and the compartment 4*b*. However, when the milling operation has milled away the first housing section 3*a* and the fastening mechanisms 20, 30, it may be possible for the housing 3 to rotate around the mandrel 2 under some circumstances. Hence, in the present embodiment, the third housing section 3*c* has a larger outer diameter than the first and second sections 3*a*, 3*b*. The outer diameter is corresponding to the outer diameter of the third mandrel section 2*c*. Here, if the outer housing 3 starts to rotate in the set state due to the milling operation, it will bring the third housing section 3*c* to a locked state, in which further rotation of the outer housing 3 is prevented. As for the third mandrel section 2*c*, the third housing section 3*c* comprises a second contact area 32 which is brought into contact with the well pipe WP in the locked state. Here, further rotation of the housing 3 in relation to the sealing assembly 10 is no longer possible, and the milling bit will again be able to mill the housing 3. Also the second contact area 32 may comprise slips 32*a*.

Moreover, tests indicate that the friction forces provided by the sealing element 13 will be sufficient to prevent the mandrel 2 from rotating during the milling operation. Due to the eccentricity of the second mandrel section 2*b* and the compartment 4*b*, the outer housing 3 will also be prevented from rotating. Hence, the first contact area 22 will not be rotated to the locked state until the milling operation has reduced the friction forces provided by the sealing element 13, i.e. that the sealing element 13 is at least partially milled away.

The tests also indicate that the milling operation may continue until some of the teeth of the lower slips 12 is milled away. This is indicated by the line Mmax in FIG. 9. At this point, the remaining parts, i.e. the parts to the right of the line Mmax will fall into the well. All parts to the left of the line Mmax have been milled into debris.

In the embodiments above, the elements of the sealing assembly 10 has a circular outer surface. However, since they are provided radially around the second mandrel section 2*b* with their circular inner surface in contact with the outer surface of the second mandrel section 2*b*, they have a different thickness around the circumference of the plugging device, as shown in FIGS., 8 and 9.

In the present embodiment, the plugging device has a maximum outer diameter of 110 mm in the run state and is to be set in a well pipe having an inner diameter of 124.8 mm. The diameter of the third mandrel section 2*c* is in the run state 110 mm, where the third mandrel radius R2*c*1 is 55 mm and the fourth mandrel radius R3*c*2 is 65 mm. Here, the second center axis I2*b* is displaced parallel in relation to the first center axis I1 with 5 mm.

The maximum thickness T3*b*1 of the second housing section 3*b* (indicated in FIG. 6) is 38 mm and the minimum thickness T3*b*2 of the second housing section 3*b* is 28 mm. When the third mandrel section 2*c* starts to rotate towards its locked state, the first contact area will preferably rotate between 120°-160° before it gets into contact with the inner surface of the well pipe WP, i.e. when the outer diameter of the plugging device is equal to the inner diameter of the well pipe. This will depend on the distance between the second center axis (I2*b*) and the first center axis (I1), but will also depend on the circularity of the well pipe itself. Hence, the eccentricity of the second mandrel section 2*b* and the compartment 4*b* should ensure that the locked state is achieved also in well pipes that are not perfectly circular in its cross section. It should be noted that in FIG. 9, the mandrel 2 and the housing 3 have been rotated 180°, here it can bee seen that the teeth of the slips 22*a*, 32*a* of the contact areas 22, 32 are drawn into the well pipe WP, a situation that in practice will not occur—the rotation will stop before a rotation of 180° is achieved. In this case, i.e. when the mandrel 2 and the housing 3 have been rotated 180°, the maximum measurable outer "diameter" is 130 mm (i.e. above the inner diameter of the well pipe it is designed for).

As mentioned in the introduction above, the materials of the mandrel 2 and the housing 3 should be made of materials that are easy to mill, such as composite materials, cast iron, brass etc. The sealing element 13 is mainly made of rubber, elastomers or similar soft materials. The materials of the other parts of the sealing assembly 10 are also be made of easy drillable materials.

In the present embodiment, the main purpose of the slips 22*a*, 32*a* of the contact areas 22, 32 are to prevent axial displacement of the housing 3 or mandrel 2 respectively. According to tests of the plugging device 1, the eccentricity of the second mandrel section 2*b* and the compartment 4*b* has been found to be sufficient to prevent rotation of the mandrel and housing in their locked state. The slips 22*a*, 32*a* will contribute to prevent such further rotation, even though their main purpose is to prevent axial displacement. It should be noted that the slips 22*a*, 32*a* could also be redesigned so that their main purpose is to prevent rotation of the mandrel 2 and housing 3 in relation to the pipe wall WP.

The invention claimed is:

1. A millable plugging device for use in a well pipe, comprising:

an inner mandrel comprising a first mandrel section and a second mandrel section, wherein the first mandrel section has a cylindrical outer surface and wherein the second mandrel section has a cylindrical outer surface;

an outer housing provided radially outside at least parts of the inner mandrel, wherein the outer housing comprises a first housing section and a second housing section, wherein the second housing section comprises a cylindrical compartment;

a sealing assembly provided radially outside the inner mandrel, wherein the sealing assembly is configured to be brought from a run state to a set state by a relative axial displacement between the inner mandrel and the outer housing, wherein the millable plugging device has a first center axis, the second mandrel section has a second center axis displaced parallel in relation to the first center axis, at least a part of the second mandrel section is provided within the cylindrical compartment in the set state, and wherein rotation of the inner mandrel in the set state is bringing a third mandrel section of the mandrel to a locked state, in which further rotation of the inner mandrel is prevented.

2. The device according to claim 1, wherein the third mandrel section comprises a first contact area which is brought into contact with the well pipe in the locked state.

3. The device according to claim 2, wherein the first contact area comprises radially protruding slips.

4. The device according to claim 1, wherein rotation of the outer housing in the set state is bringing a third housing section of the outer housing to a locked state, in which further rotation of the outer housing is prevented.

5. The device according to claim 4, where the third housing section comprises a second contact area which is brought into contact with the well pipe in the locked state.

6. The device according to claim 5, where the second contact area comprises radially protruding slips.

7. The device according to claim 1, wherein the third mandrel section is provided below the sealing assembly.

8. The device according to claim 1, wherein the first mandrel section is guided through an opening provided in the first housing section.

9. The device according to claim 1, wherein the first mandrel section comprises a first fastening mechanism and the first housing section comprises a second fastening mechanism, wherein the first fastening mechanism can be fastened to the second fastening mechanism during setting of the plugging device.

10. The device according to claim 9, wherein the first and second fastening mechanisms are provided by a ratchet mechanism.

* * * * *